US006220533B1

(12) United States Patent
Börner et al.

(10) Patent No.: US 6,220,533 B1
(45) Date of Patent: Apr. 24, 2001

(54) POWDER-SPRAYING APPARATUS WITH INTERNAL AND EXTERNAL CHARGING

(75) Inventors: Gunter Börner, Mühlhausen; Johann Christoph Nienburg, Heidelberg; Jörg Sopka, Schwetzingen; Josef Wittmann, Hockenheim, all of (DE)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/370,688

(22) Filed: Aug. 9, 1999

(30) Foreign Application Priority Data

Aug. 7, 1998 (EP) ..... 98114846

(51) Int. Cl.[7] ..... B05B 5/00; F23D 11/32
(52) U.S. Cl. ..... 239/690.1; 239/698; 239/706
(58) Field of Search ..... 239/690, 704, 239/706, 707

(56) References Cited

U.S. PATENT DOCUMENTS 3,167,255 * 1/1965 Point et al. ..... 239/706
4,576,827 * 3/1986 Hastings et al. ..... 239/706 X
5,904,294 * 5/1999 Knobbe et al. ..... 239/706 X

FOREIGN PATENT DOCUMENTS

98/245555 * 6/1998 (WO) ..... 239/706

* cited by examiner

*Primary Examiner*—Patrick Brinson
*Assistant Examiner*—Davis Hwu
(74) *Attorney, Agent, or Firm*—Herbert L. Lerner; Laurence A. Greenberg; Werner H. Stemer

(57) ABSTRACT

A powder-spraying apparatus having simultaneous internal and external charging, which is suitable for electrostatic powder coating. In order to achieve improved constancy of the deposition efficiency, largely independent of the distance between the powder-spraying apparatus and the work piece, it is proposed to connect both internal high-voltage electrodes and external high-voltage electrodes to a high-voltage source via high-resistance components.

7 Claims, 3 Drawing Sheets

POWDER-SPRAYING APPARATUS WITH INTERNAL AND EXTERNAL CHARGING

BACKGROUND OF THE INVENTION

Field of the Invention

The invention relates to a powder-spraying apparatus having simultaneous internal and external charging, which is suitable for a electrostatic powder coating.

Such a powder-spraying apparatus is disclosed in International Patent Application WO 98/24555. The reference teaches a spray gun having a chamber, into which a powder/air mixture can be introduced. The spray gun contains an earth electrode, needle-like internal high-voltage electrodes distributed on a metal ring, and at least one external high-voltage electrode configured as a needle. A high-voltage source configured as a high-voltage cascade supplies high voltage to the electrodes via an electrical connection and the ring.

The at least one external high-voltage electrode is referred to as an additional electrode which can be disposed as desired, with which an electric field and an additional corona can be produced outside, these being intended to increase the deposition efficiency. The electric field generated by the external needle produces a force on the electrically charged particles. In addition, the external corona can effect further charging, and the repulsion between the ions and the charged powder particles can lead to broadening of the spray cloud. Which of the physical influencing factors listed are dominant depends on the quantity of powder expelled, the properties of the powder (good or poor chargeability) and a distance from a work piece.

In the case of small quantities of powder (up to about 150 g/min) and normally chargeable powders, a sufficiently good quantity of charge can be applied to the powder particles using the internal charging on its own. The electric field built up by the external needle has the effect of a force F=E*q acting on the powder particles. Depending on the voltage on the needle tip, the result is a more or less pronounced edge effect or wrap-around. The width of the spray cloud can be influenced by the level of the current.

In the case of greater quantities of powder (greater than 200 g/min), both the internal and the external charging are required for sufficiently high charging of the powder particles.

However, the disadvantage of a configuration with a metallic connection between the electrodes is that the current and voltage on the external needle depend to a great extent on the distance between the gun and the work piece. At a small distance, a much greater current flows, and the voltage is lower than in the case of a large distance. As a result, in particular at high powder expulsion quantities, there may be an increase in the tendency that the deposition efficiency increases with a decreasing distance.

However, this tendency is not desired in practice. Within a technically expedient range (100 mm . . . 250 mm), the aim is that the deposition efficiency should be uniformly high, irrespective of the distance.

In order to produce the high voltage (negative direct voltage), a cascade with a relatively high internal resistance is used. The no-load voltage $U_0$, that is the output voltage of the cascade in the unloaded state, normally lies in the range of about −80 kV to −100 kV. The internal resistance of the cascade $R_i$ lies in the range of about 400 MΩ to 600 MΩ. The actual output voltage of the cascade $U_c$, together with the output current $I_c$, is then calculated in accordance with the following equation:

$$U_c=U_0-I_cR_i$$

The maximum output current of the cascade is about 80 μA . . . 120 μA. The use of cascades with greater output voltages and smaller internal resistances is not possible, for reasons of safety. The relevant standards in Europe and America require that the air/powder mixture must not be ignited by electric discharges under any circumstances. Therefore, inter alia, the output of the cascade is limited. Further measures for avoiding ignition are bias resistors and the avoidance of electrode configurations that lead to a high electric capacitance.

During powder application, attempts are made to operate at a constant distance. However, for various reasons it is not possible to avoid the distance from the work piece changing (for example at edges).

SUMMARY OF THE INVENTION

It is accordingly an object of the invention to provide a powder-spraying apparatus with internal and external charging that overcomes the above-mentioned disadvantages of the prior art devices of this general type, in which improved constancy of the deposition efficiency can be achieved.

With the foregoing and other objects in view there is provided, in accordance with the invention, a powder-spraying apparatus equipped for simultaneous internal and external powder charging, including:

- a high-voltage source;
- an earth electrode;
- at least one external high-voltage electrode;
- a plurality of internal high-voltage electrodes;
- a ring formed of high-resistance material and having a circumference, the plurality of internal high-voltage electrodes uniformly distributed about the circumference of the ring; and
- connection elements formed of the high-resistance material connecting the high-voltage source to both the at least one external high-voltage electrode and the ring.

Other features which are considered as characteristic for the invention are set forth in the appended claims.

Although the invention is illustrated and described herein as embodied in a powder-spraying apparatus with internal and external charging, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
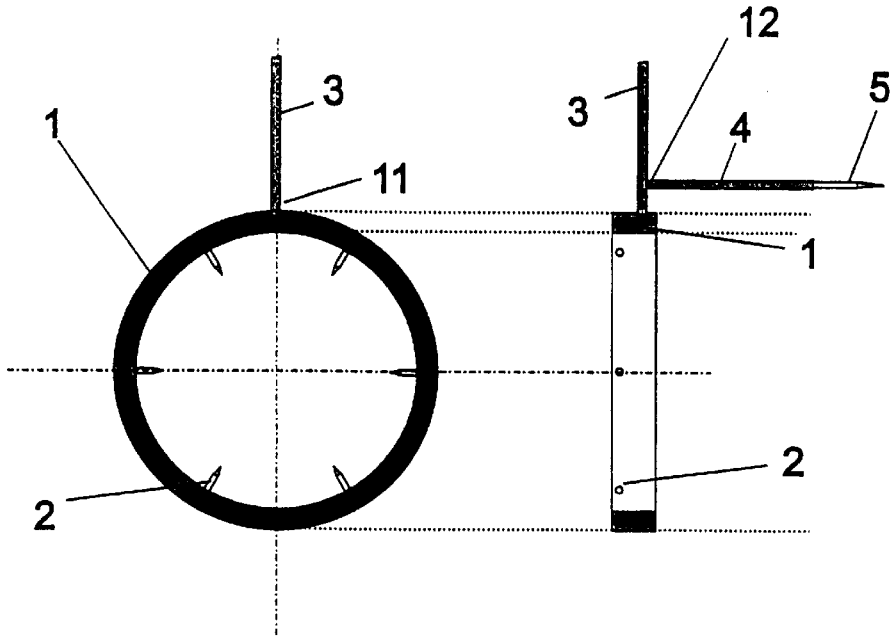
FIG. 1 is a front elevational and a corresponding side-elevational view of a configuration of internal and external electrodes including high-resistance connecting parts, according to the invention.

The objective of improved constancy of the deposition efficiency is achieved with the powder-spraying apparatus according to the invention by a ratio between internal and external currents being set specifically, and changing only within narrow limits when there are changes in a distance between an electrode and a work piece. At a typical nominal distance of 200 mm from the work piece, about 70% of the current flows via the electrodes for an internal charging, and 30% via an external electrode.

In all the figures of the drawing, sub-features and integral parts that correspond to one another bear the same reference symbol in each case. Referring now to the figures of the drawing in detail and first, particularly, to FIG. 1 thereof, there is shown a front view and a side view of a ring 1 made of a high-resistance material. The high-resistance material used for the ring 1 and further high-resistance components—described below—may be, for example, a plastic which is filled with graphite, carbon black or other conductive materials. A number of needle-like internal high-voltage electrodes 2 are inserted into the ring 1, distributed uniformly over its internal circumference. The ring 1 can be connected to a high-voltage source (cascade) 6 via a high-resistance rod 3 (see FIG. 2 and FIG. 5). A connection point 11 for the rod 3 is located at a center of a ring portion located between two of the electrodes 2. A needle-like external high-voltage electrode 5 is connected to the rod 3 at a connection point 12 via a high-resistance pin 4.

The current and voltage distribution which can be achieved with such a configuration is determined by the resistance values of the components 1, 3 and 4 and the current/voltage characteristic of the gas discharge paths of the:

a. needle ring to internal earth electrode path; and b. external needle to work piece path.

Figure 2:
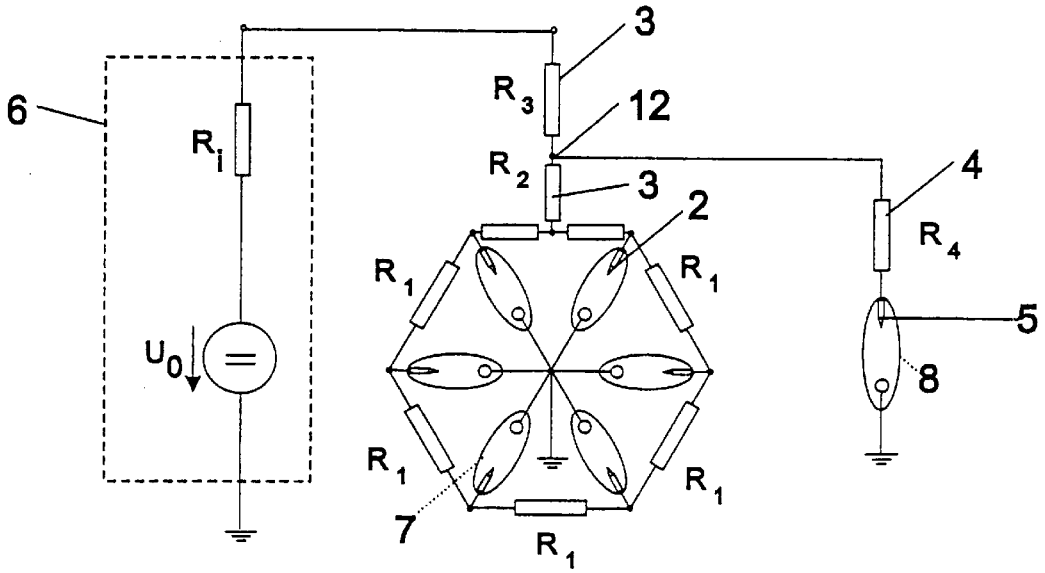
FIG. 2 is a complete electrical equivalent circuit diagram of the configuration shown in FIG. 1.

For improved understanding, FIG. 2 shows the complete electric equivalent circuit of the configuration shown in FIG. 1, which is connected to the high-voltage cascade 6. The cascade 6 is simulated by an ideal voltage source having a voltage $U_0$ and a resistance $R_i$. The discharge paths for an internal charging 7 and an external charging 8 are given by their current/voltage characteristics. Portions of the ring 1 located between the internal electrodes 2 are in each case simulated by resistances $R_1$. The resistance of the rod 3 is divided by the connection point 12 for the pin 4 into resistances $R_2$ and $R_3$. The rod 4 is simulated by the resistance $R_4$.

Figure 3:
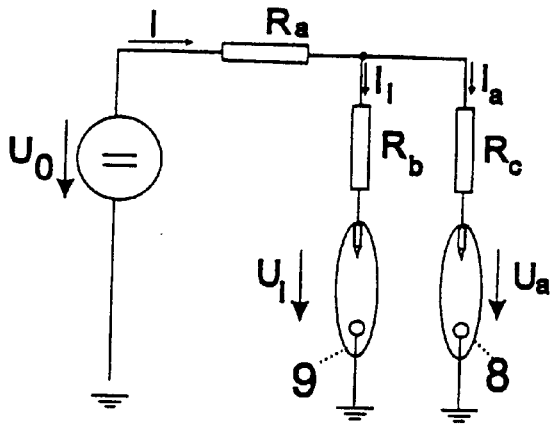
FIG. 3 is a circuit diagram of a simplified equivalent circuit.

For the purpose of configuring the resistances, a simplification of the equivalent circuit is expedient, and this is shown in FIG. 3. A resistance $R_a$ combines the resistances $R_i$ and $R_3$. The components that are relevant to the internal discharge have been combined, to a first approximation, by a resistance $R_b$ and a gas discharge path 9. $R_c$ is equal to $R_4$.

Figure 4:
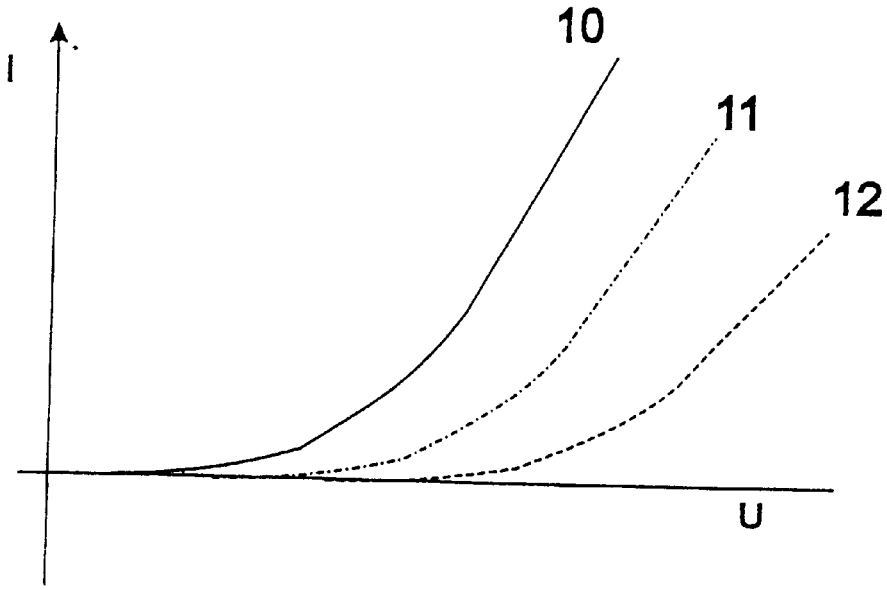
FIG. 4 is a graph showing associated current-voltage characteristics.

Associated typical current/voltage characteristics are illustrated by way of example in FIG. 4. The characteristic curve 10 applies to the internal discharge, and characteristic curves 11 and 12 apply to the external discharge at two different distances from the work piece. The distance in the case of characteristic curve 11 is smaller than in the case of characteristic curve 12.

The characteristic curves can be approximated using the below listed equations.

$$\text{The internal discharge}-I_i=C_i(U_i-U_{i0})^2,$$

where $C_i$ and $U_{i0}$ are characteristic variables that depend on a geometric construction of the gun, and depend in particular on the distance of the needle-electrode ring from the internal earth electrode.

$$\text{The external discharge}-I_a=C_a(U_a-U_{a0})^2,$$

where $C_a$ and $U_{a0}$ are characteristic variables that depend both on the geometric construction of the gun but, to a significantly greater extent, on the distance between the gun and the work piece and also on a shape of the work piece. The result is therefore different characteristics for different positions of the work piece.

The characteristic variables $C_i$, $U_{i0}$, $C_a$ and $U_{a0}$ can be determined from the geometric dimensions and the material characteristics, using a numerical field calculation. However, an experimental check is to be recommended. The influence of the quantity of powder delivered can be neglected here.

The equivalent circuit is described by the following system of equations:

$$U_0=R_aC_a(U_a-U_{a0})^2+(R_a+R_b)C_i(U_i-U_{i0})^2+U_i,$$

and $$U_0=R_aC_i(U_i-U_{i0})^2+(R_a+R_c)C_i(U_a-U_{a0})^2+U_a.$$

Using these equations, the values for the resistances can be optimized. The following guide values having emerged from an exemplary embodiment:

$$R_a=400\ \text{M}\Omega\ldots 600\ \text{M}\Omega,$$

$$R_b=20\ \text{M}\Omega\ldots 200\ \text{M}\Omega,$$

and $$R_c=(2\ldots 5)*R_b.$$

For $R_c$, it is true to a first approximation that the greater $R_c$ is, the greater is the edge effect.

The resistance $R_1$ should lie in the range of about 10 MΩ to about 30 MΩ. This resistance prevents field strength peaks, and hence high currents, occurring in the event of direct contact between the powder and the internal needles.

Figure 5:
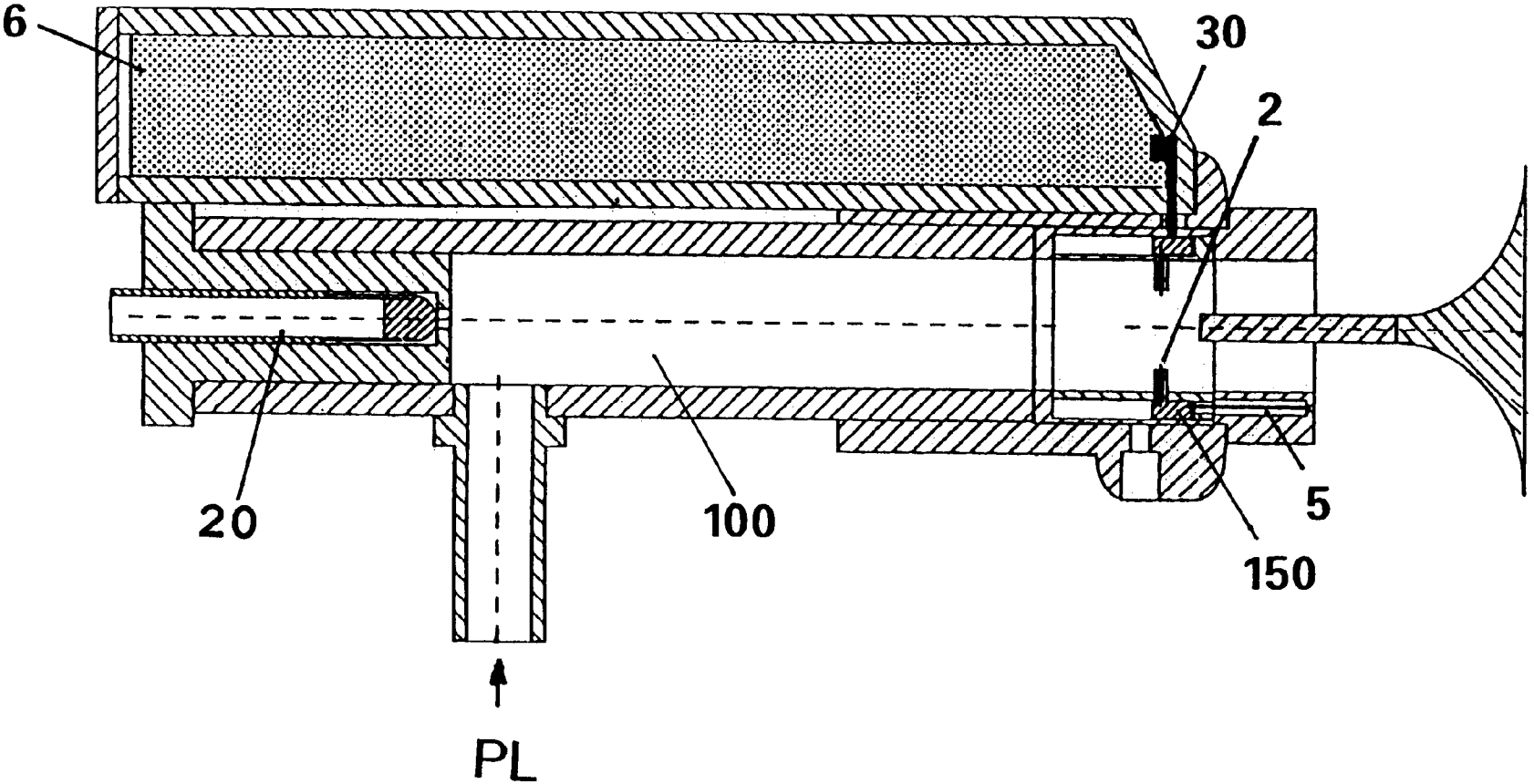
Fig. 5 Prior Art
FIG. 5 is a sectional view a powder-spraying apparatus known from the prior art, into which the configuration shown in FIG. 1 can be inserted instead of the electrode configuration shown in FIG. 5.

FIG. 5 shows the powder-spraying apparatus disclosed in International Patent Application WO 98/24555. The spray gun disclosed has a chamber 100, into which a powder/air mixture PL can be introduced. The spray gun contains an earth electrode 20, the needle-like internal high-voltage electrodes 2 disposed distributed on a metal ring 150, and the at least one external high-voltage electrode 5 configured as a needle. The high-voltage source 6 configured as a high-voltage cascade supplies high voltage to the electrodes 5, 2 via an electrical connection 30 and the ring 150. The inventive features of FIG. 1 are to replace equivalent features shown in FIG. 5 for providing a better consistency in the delivery of the powder.

We claim:

1. A powder-spraying apparatus comprising:

a high-voltage source;

an earth electrode;

at least one external high-voltage electrode provided for an external powder charging;

a plurality of internal high-voltage electrodes, said earth electrode and said plurality of internal high-voltage electrodes being provided for an internal powder charging;

a ring formed of high-resistance material and having a circumference, said plurality of internal high-voltage electrodes uniformly distributed about said circumference of said ring, said ring having regions lying between said plurality of internal high-voltage electrodes and said regions having an ohmic resistance in a range of between 10 to 30 MΩ;

connection elements formed of said high-resistance material connecting said high-voltage source to both said at least one external high-voltage electrode and said ring; and said high-voltage source providing a first current to said plurality of internal high-voltage electrodes and a second current to said at least one external high-voltage electrode; and said connection elements and said ring being provided for setting a desired ratio between the first current and the second current.

2. The powder-spraying apparatus according to claim 1, wherein said high-resistance material is a plastic filled with a material selected from the group consisting of graphite, carbon black and other conductive materials.

3. The powder-spraying apparatus according to claim 1, wherein said connection elements have a d.c. resistance in each case of at least 1 MΩ.

4. The powder-spraying apparatus according to claim 1, wherein said connection elements include a high-resistance pin and a feed rod, said at least one external high-voltage electrode is connected via said high-resistance pin and said feed rod to said ring.

5. The powder-spraying apparatus according to claim 1, wherein said ring and said connection elements have d.c. resistances selected such that with a nominal distance of 200 mm between the powder-spraying apparatus and a work piece, results in a division of a current of about 70% via said plurality of internal high-voltage electrodes and about 30% via said at least one external high-voltage electrode.

6. The powder-spraying apparatus according to claim 1, wherein:

said connection elements include a high-resistance feed rod;

said ring has electrode connection points, said internal high-voltage electrodes are connected to said ring at said electrode connection points;

said ring has a feed rod connection point provided, equidistant between two neighboring ones of said electrode connection points, in one of said regions; and said high-resistance feed rod is connected to said ring at said feed rod connection point.

7. The powder-spraying apparatus according to claim 6, wherein:

said connection elements further include a high-resistance pin;

said at least one external high-voltage electrode is a single needle-shaped high-voltage electrode;

said high-resistance feed rod has a given connection point; and said needle-shaped high-voltage electrode is connected, via said high-resistance pin, to said given connection point of said high-resistance feed rod.

* * * * *